US007992951B2

(12) United States Patent
Kim et al.

(10) Patent No.: US 7,992,951 B2
(45) Date of Patent: Aug. 9, 2011

(54) DOOR OPENING AND CLOSING DEVICE FOR REFRIGERATOR

(75) Inventors: Seong Jae Kim, Ansan-si (KR); Jang Ho Shim, Seoul (KR); Ki Chul Woo, Seoul (KR); Sang Yeul Lee, Seoul (KR); Joon Hwan Oh, Seoul (KR); Seung Yup Kim, Suwon-si (KR); Jong Ho Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 184 days.

(21) Appl. No.: 11/352,207

(22) Filed: Feb. 13, 2006

(65) Prior Publication Data

US 2006/0232176 A1 Oct. 19, 2006

(30) Foreign Application Priority Data

Apr. 16, 2005 (KR) ..... 10-2005-0031738

(51) Int. Cl.
*A47B 96/00* (2006.01)

(52) U.S. Cl. ..... 312/405

(58) Field of Classification Search ..... 312/405, 312/401, 405.1, 319.2, 329, 326, 296; 16/50, 16/242, 350, 364, 362; 49/276; 62/265, 62/440

See application file for complete search history.

(56) References Cited

U.S. PATENT DOCUMENTS

| | | | | |
|---|---|---|---|---|
| 4,609,234 | A * | 9/1986 | Naniwa et al. | 312/296 |
| 5,027,473 | A * | 7/1991 | Hottmann | 16/286 |
| 5,522,656 | A * | 6/1996 | Jenkins | 292/79 |
| 5,931,554 | A * | 8/1999 | Koopman | 312/405 |
| 7,192,105 | B2 * | 3/2007 | Jung | 312/405 |
| 2004/0093799 | A1 * | 5/2004 | Yoshikawa et al. | 49/192 |
| 2006/0043853 | A1 | 3/2006 | Chung | |

FOREIGN PATENT DOCUMENTS

| | | |
|---|---|---|
| JP | 57-073381 | 5/1982 |
| JP | 57-073383 | 5/1982 |
| JP | 2003-003731 | 1/2003 |

OTHER PUBLICATIONS

English Language Abstract of JP 2003-003731.
Partial English Language Translation of JP 57-073383.

* cited by examiner

*Primary Examiner* — James O Hansen

(74) *Attorney, Agent, or Firm* — Birch, Stewart, Kolasch & Birch, LLP

(57) ABSTRACT

A door opening and closing device for a refrigerator includes plural doors for opening and closing a refrigerator main body; a hinge unit for connecting the corresponding door to the refrigerant main body so that the door can perform rotational motion or translational motion against the refrigerant main body; first interference units provided between the corresponding door and the refrigerant main body, and contacting from a state in which the door is closed to a state in which the door is opened to a designated angle for separating the doors; and second interference units provided between the corresponding door and the refrigerant main body, and contacting from the state in which the door is opened above the designated angle for separating the doors. The door opening and closing device reduces noise and impact generated by the opening and closing of the doors, allowing a user to open and close the doors more softly and smoothly.

11 Claims, 14 Drawing Sheets

DOOR OPENING AND CLOSING DEVICE FOR REFRIGERATOR

BACKGROUND OF THE INVENTION

1. Field of the Invention

The present invention relates to a door opening and closing device for a refrigerator having a side-by-side door configuration, and more particularly to a door opening and closing device for a refrigerator, in which both doors are separated from each other to divide gaskets when one door is opened.

2. Description of the Related Art

FIG. 1 is a perspective view of a refrigerator having a conventional door opening and closing device.

As shown in FIG. 1, the refrigerator comprises a refrigerating chamber 1 located in the upper portion thereof, and a freezing chamber 2 located in the lower portion thereof. The above refrigerator is a French-type refrigerator which does not comprise a partition for dividing the refrigerating chamber 1.

Doors 3 for opening and closing the refrigerating chamber 1 are installed in a side-by-side configuration, and gaskets 10 for preventing cold air in the refrigerating chamber 1 from leaking to the outside are installed on the circumferential surface of the doors 3 and contact a refrigerator main body 5.

Side gaskets 11 for preventing cold air in the refrigerating chamber 1 from leaking to the outside are installed on inner side surfaces of doors 3, which contact each other. Generally, a French-type refrigerator has a filler structure in which a filler is installed on one door so that the side gaskets 11 of both doors 3 come into contact, or a fillerless structure in which the side gaskets 11 of both doors 3 contact without a filler.

The refrigerator of FIG. 1 is a fillerless type refrigerator, in which the side gaskets 11 installed on both doors 3 come into contact under the condition that the doors 3 are closed, thereby sealing a gap between the doors 3.

FIG. 2 is a schematic plan view of the conventional refrigerator in a state in which the side gaskets 11 come into contact under the condition that both doors 3 are closed.

Each of the side gaskets 11 has a magnetic body 14 installed therein so as to maintain attractive force between the side gaskets 11. When one door 3 is opened, the opponent door 3 is opened together.

In order to solve the above problem, there is proposed a door separating structure for separating both doors 3 from each other so that both side gaskets 11 are separated from each other when one door 3 is initially opened and when the door 3 is nearly closed.

That is, a hinge unit 15 for connecting the door 3 to the refrigerator main body 5 comprises a hinge link 17 so that the door 3 can horizontally move, i.e., can be translated when the door 3 is opened or closed. Both ends of the hinge link 17 are rotatably connected to a hinge bracket 16 installed on the refrigerator main body 5 and the door 3.

The hinge unit 15 further comprises an elastic member 18 for providing elastic force to the door 3 so that the door 3 contacts the opponent door 3.

A cam member 21 for moving the door 3 by the interference when the door 3 is opened or closed is installed on the refrigerator main body 5, and a cam contact lever 25 contacting the cam member 21 is installed on the door 3. A roller 26, which rolls on the cam member 21, is installed on the cam contact lever 25.

Accordingly, when one door 3 is opened at a small angle, the door 3 is rotated centering on a door hinge shaft 17*a*. The roller 26 of the cam contact lever 25 moves along the cam plane of the cam member 21 according to the displacement of the door 3. When the roller 26 reaches the vertex of the cam plane, the door 3 is pushed backwards centering on a main body hinge shaft 17*b*, is separated from the opponent door 3, and is opened under the condition that both side gaskets 11 are separated from each other.

When the door 3 is opened at a larger angle, the door 3 is rotated centering on the door hinge shaft 17*a*.

On the other hand, when the door 3 is closed, the roller 26 of the cam contact lever 25 moves along the curved plane of the cam member 21. Thereby, the door 3 is closed under the condition that both side gaskets 11 are separated from each other.

As described above, when the door 3 is opened or closed, since the door 3 is separated from the opponent door 3, the interference between both side gaskets 11 is minimized. Accordingly, it is possible to prevent the temporary opening of one door 3 together with the opening of the opponent door 3 and the rapid abrasion of the side gaskets 11 due to the frequent contact between the side gaskets 11.

In the refrigerator having the above-described conventional door opening and closing device, when the door 3 is closed, as shown in FIG. 4, the roller 26 of the cam contact member 25 collides with the cam member 21, thereby generating noise and impact. Further, when the door 3 is closed, the door 3 is rapidly pushed backwards, thereby drastically decreasing user's tactility when the door 3 is opened or closed.

When the door opening and closing device is used for a long time under the above state, the roller 26 is damaged due to the frequent collision between the roller 26 and the cam member 21, and the gasket separating operation cannot be smoothly performed.

Since the cam member 21 is protruded from the refrigerator main body 5 towards the door 3, when a user opens the door 3, the aesthetic appearance of the refrigerator is poor. Further, in order to reduce impact generated when the door 3 is closed, the cam plane must have a gentle slope and the cam member 21 must have a large protrusion distance.

The above door opening and closing structure is described by "Door opening and closing device for refrigerator" (disclosed in Japanese Patent Laid-open Publication No. 1982-73381). In the structure of the above door opening and closing device, a cam member is protruded forwards from a refrigerator main body. If the cam member is not protruded forwards from the refrigerator main body, a cam profile has a steep gradient, thereby increasing impact and noise when a door is opened or closed.

SUMMARY OF THE INVENTION

Therefore, the present invention has been made in view of the above problems, and it is an object of the present invention to provide a door opening and closing device for a refrigerator, which separately comprises interference units for separating doors from each other when one door is opened and interference units for separating the doors from each other when the door is closed, thereby reducing impact and noise generated by the opening and closing of the door. Accordingly, the door opening and closing device of the present invention allows a user to open and close the door more softly and smoothly, and improves durability of parts of the interference units.

It is another object of the present invention to provide a door opening and closing device for a refrigerator, in which cam members are not protruded from a refrigerator main body, thereby improving the external appearance of the refrigerator when one door is opened.

In accordance with one aspect of the present invention, the above and other objects can be accomplished by the provision of a door opening and closing device for a refrigerator comprising: a plurality of doors for opening and closing a refrigerator main body; a hinge unit for connecting the corresponding door to the refrigerant main body so that the door can perform rotational motion or translational motion against the refrigerant main body; first interference units provided between the corresponding door and the refrigerant main body, and contacting from a state in which the door is closed to a state in which the door is opened to a designated angle for separating the doors; and second interference units provided between the corresponding door and the refrigerant main body, and contacting from the state in which the door is opened above the designated angle for separating the doors.

Gasket assemblies for sealing a gap between the doors may be installed between the doors.

The hinge unit may comprise a hinge link, both ends of which are rotatably connected to the refrigerant main body and the corresponding door.

The hinge unit may further comprise an elastic member for providing elastic force so that the door moves in the direction in which the door contacts the opponent door.

The first interference units may comprise a first cam member fixed to the refrigerator main body, and a first cam contact lever fixed to the door and contacting the first cam member for separating the doors.

The first cam member may be located on the upper surface of the refrigerator main body, and the first cam contact lever may be protruded from the upper surface of the door towards the refrigerator main body.

The second interference units may comprise a second cam member fixed to the door, and a second cam contact lever fixed to the refrigerator main body and contacting the second cam member for separating the doors.

The second cam member may be located on the upper surface of the door, and the first cam contact lever may be protruded from the upper surface of the refrigerator main body towards the door.

A portion of a cam plane of the second cam member, contacting the second cam contact lever when the door is opened above the designated angle, may be curved at a gradient less than that of the other portion of the cam plane of the second cam member, and the portions of the cam plane may be divided by a vertex.

The second interference units may be disposed between the first interference units and the hinge unit.

A cam plane of the first cam member and a cam plane of the second cam member may be convexly curved planes.

The cam plane of the first cam member and the cam plane of the second cam member may be protruded in the directions in which the cam planes face each other.

A portion of the cam plane of the first cam member, contacting the first cam contact lever when the door is opened, may be relatively steeply curved, and a portion of the cam plane of the second cam member, contacting the second cam contact lever when the door is closed, may be relatively gently curved.

At least one of the first cam contact lever and the second cam contact lever may comprise a roller rolling on the first or second cam member.

The second interference units comprise a second cam member fixed to the refrigerator main body, and a second cam contact lever fixed to the door and contacting the second cam member for separating the doors.

In accordance with another aspect of the present invention, there is provided a door opening and closing device for a refrigerator comprising: a plurality of doors for opening and closing a refrigerator main body; a hinge unit for connecting the corresponding door to the refrigerator main body so that the door can perform rotational motion or translational motion against the refrigerator main body; a cam member installed on the door; and a cam contact lever installed on the refrigerator main body and contacting the cam member for separating the doors when the door is opened or closed.

The cam member may be located on the upper surface of the door, and the cam contact lever may be protruded from the upper surface of the refrigerator main body towards the door.

A portion of a cam plane of the cam member, contacting the cam contact lever when the door is opened above a designated angle, may be curved at a gradient less than that of the other portion of the cam plane of the cam member, and the portions of the cam plane may be divided by a vertex.

The door opening and closing device of the present invention separately comprises interference units for separating doors from each other when one door is opened and interference units for separating the doors from each other when one door is closed, thereby reducing impact and noise generated by the opening and closing of the doors and thus allowing a user to open and close the doors more softly and smoothly.

Further, the door opening and closing device of the present invention minimizes impact generated by the opening and closing of the doors, thereby improving durability of elements of the interference units for separating the doors from each other. The door opening and closing device of the present invention minimizes the protruding of cam contact levers from a refrigerator main body, thereby improving the external appearance of the refrigerator when the door is opened.

Moreover, since a cam plane used when the door is initially opened and a cam plane used after the door is opened are separately formed, the door opening and closing device of the present invention reduces impact generated by the opening and closing of the door compared to the conventional door opening and closing device using a pair of interference units, thereby improving user's tactility.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

For reference, the present invention may be applied to a refrigerator, which does not comprise one of a freezing chamber and a refrigerating chamber, or comprises a side-by-side door configuration. Further, the present invention may be applied to a refrigerator, both doors of which are opened in the vertical direction as well as a refrigerator, both doors of which are opened in the horizontal direction. Accordingly, the present invention is applicable to any refrigerator, in which side gasket assemblies for sealing a gap between both doors are installed on opposite portions of both doors.

The embodiments of the present invention describe a French-type refrigerator, in which side-by-side doors are installed on one refrigerating chamber and are opened in the horizontal direction.

Figure 1:
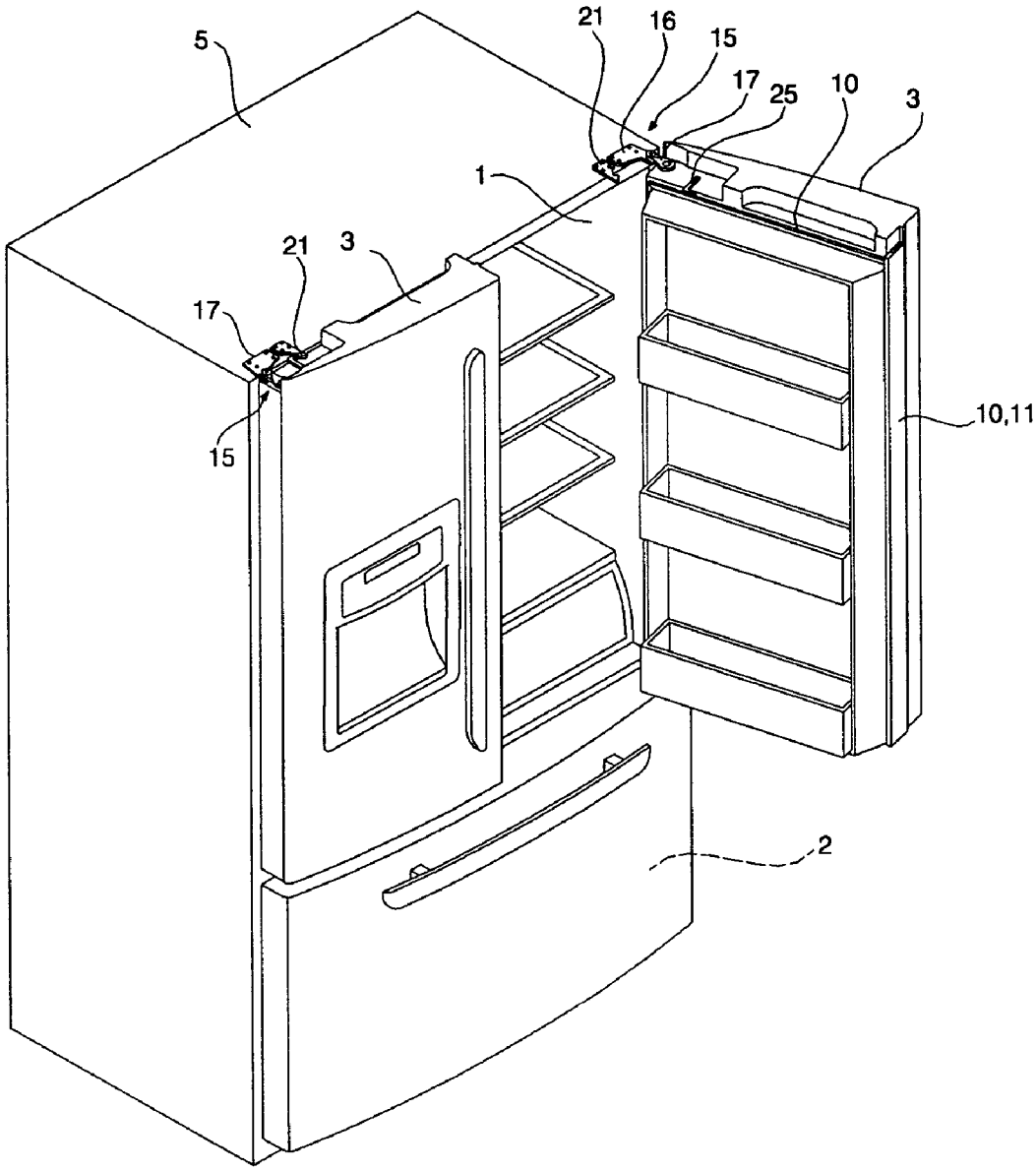
FIG. 1 (Prior Art)
FIG. 1 is a perspective view of a refrigerator having a conventional door opening and closing device.
Figure 2:
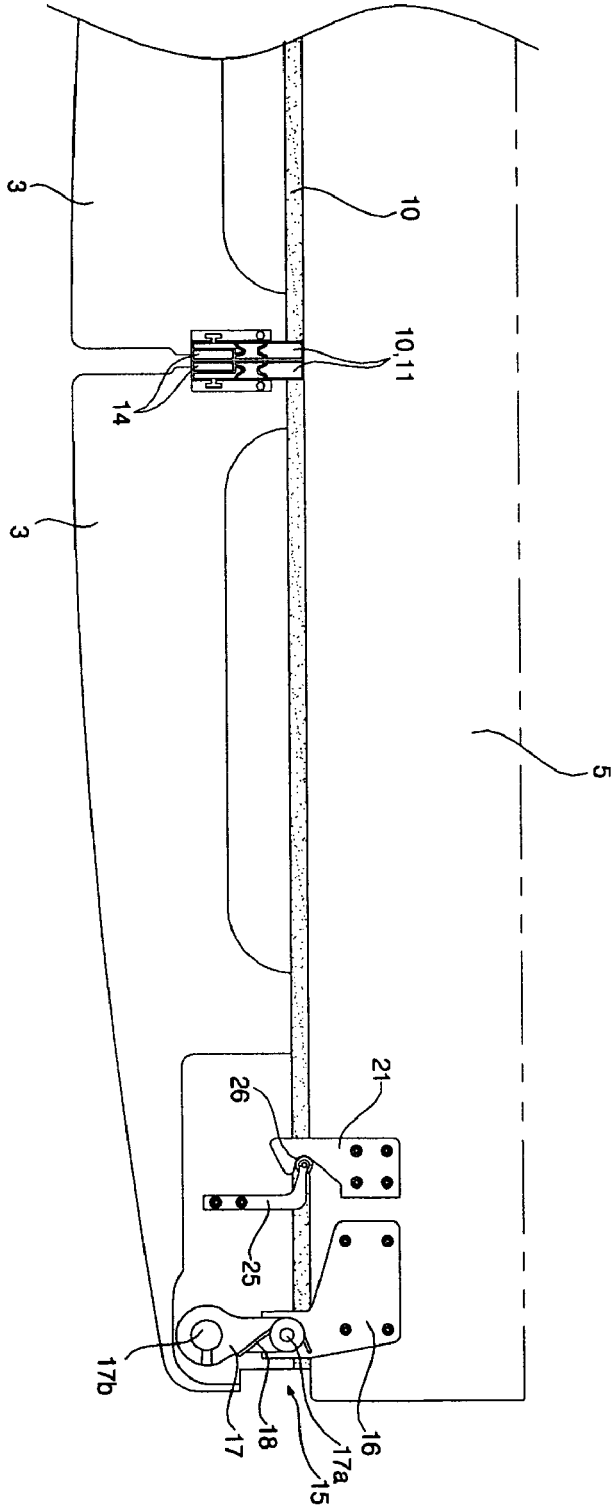
FIG. 2 (Prior Art)
FIG. 2 is a schematic plan view of the conventional refrigerator in a state in which doors are closed.
Figure 3:
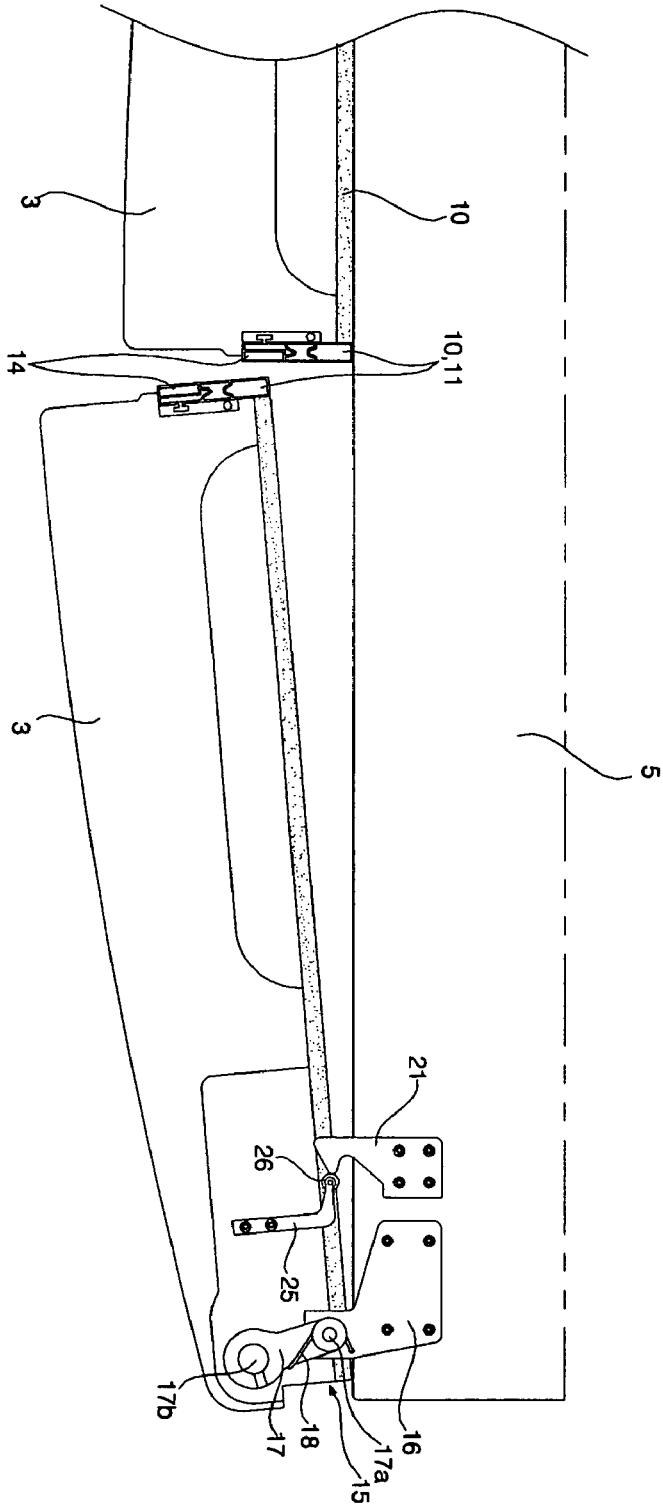
FIG. 3 (Prior Art)
FIG. 3 is a schematic plan view of the conventional refrigerator in a state in which gaskets are separated from each other when one door is opened or closed.
Figure 4:
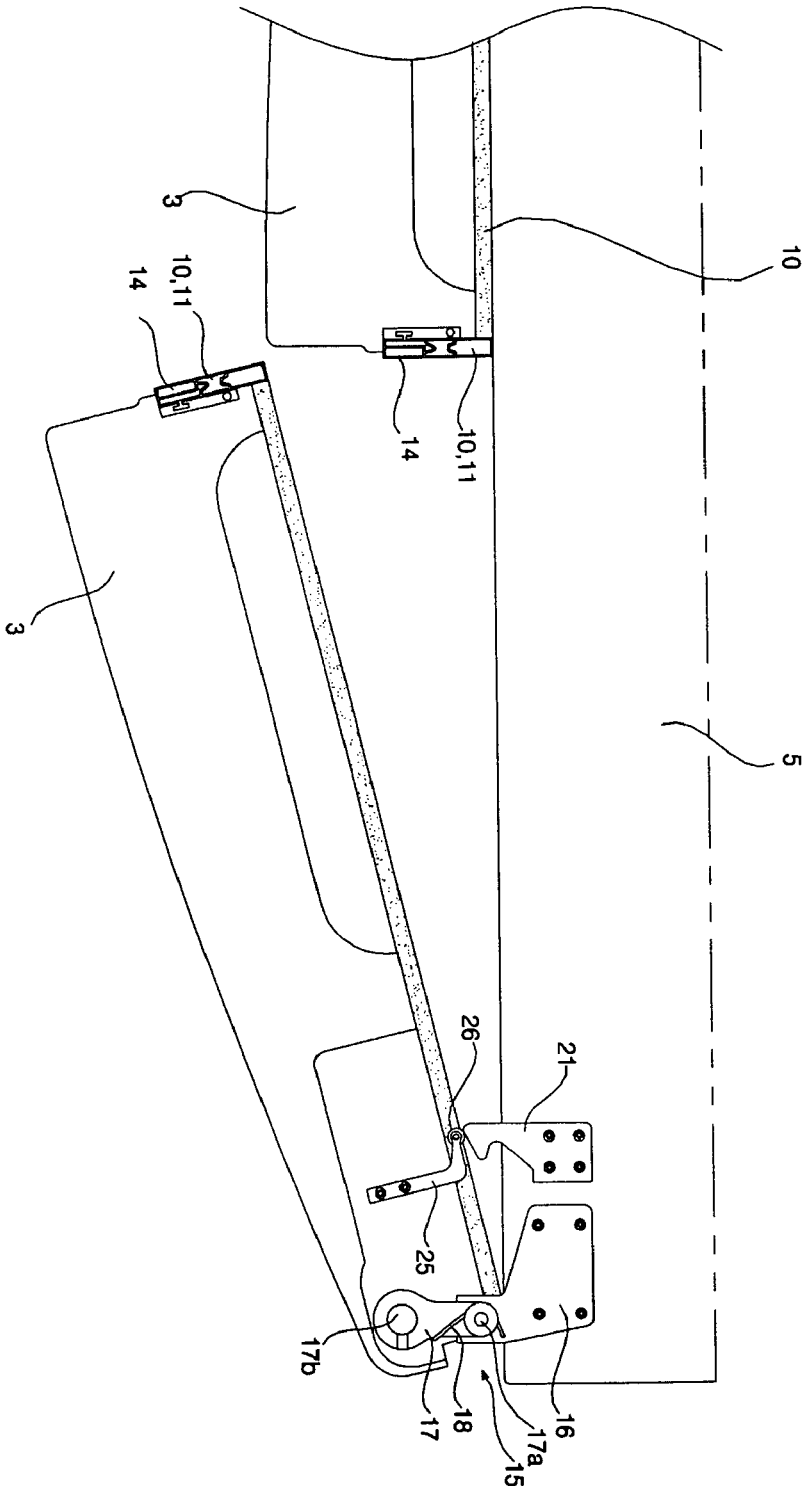
FIG. 4 (Prior Art)
FIG. 4 is a schematic plan view of the conventional refrigerator in a state in which impact is generated when the door is closed.
Figure 5:
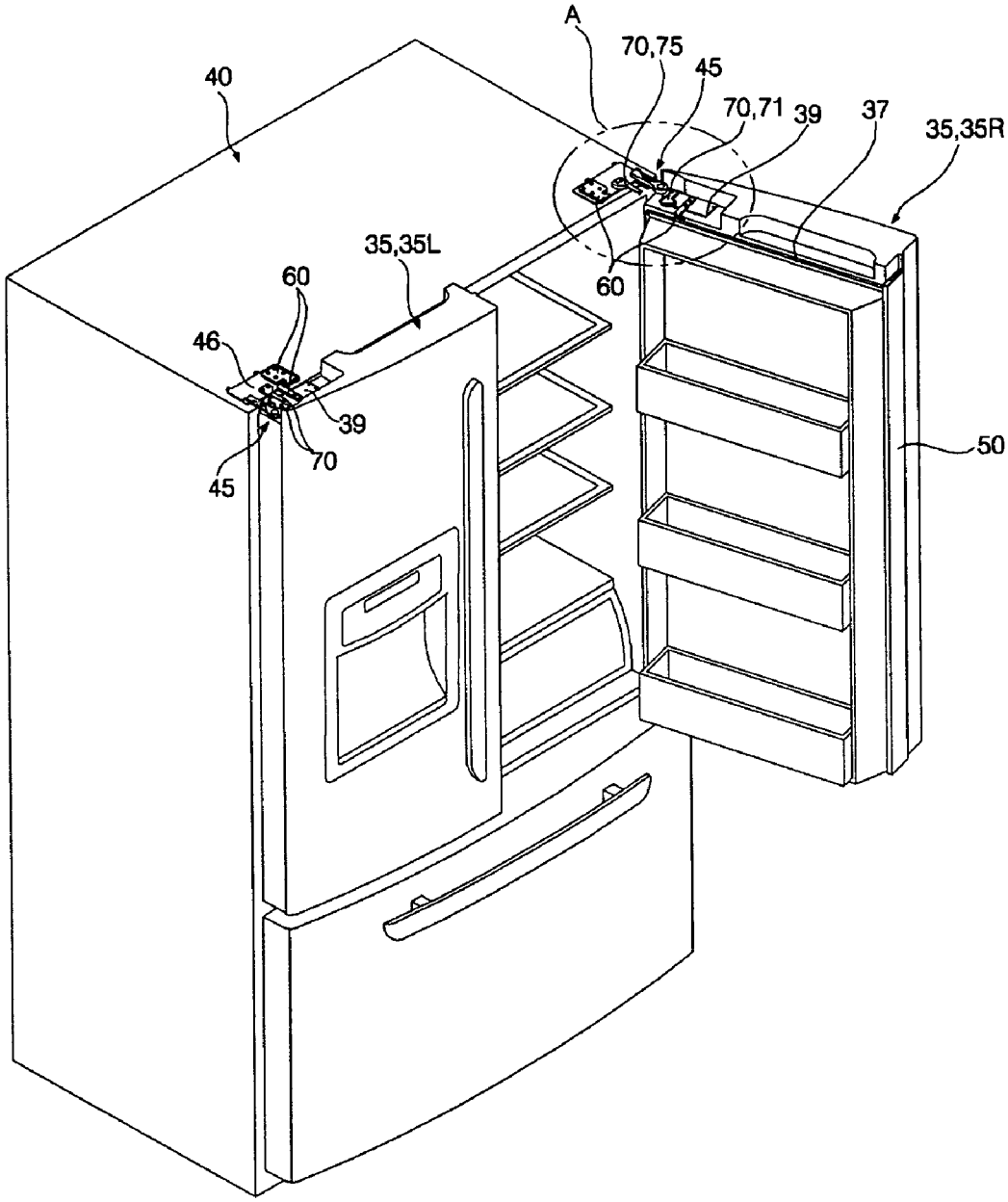
FIG. 5 is a perspective view of a refrigerator having a door opening and closing device in accordance with a first embodiment of the present invention.
Figure 6:
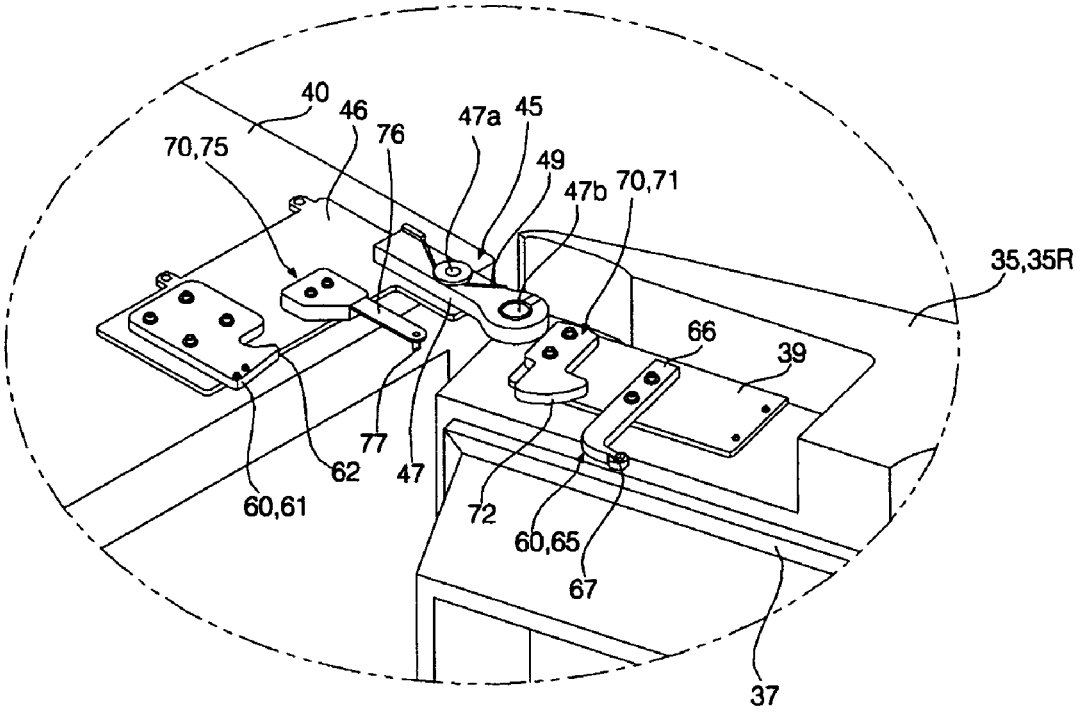
FIG. 6 is an enlarged view of the portion "A" of FIG. 5.
Figure 7:
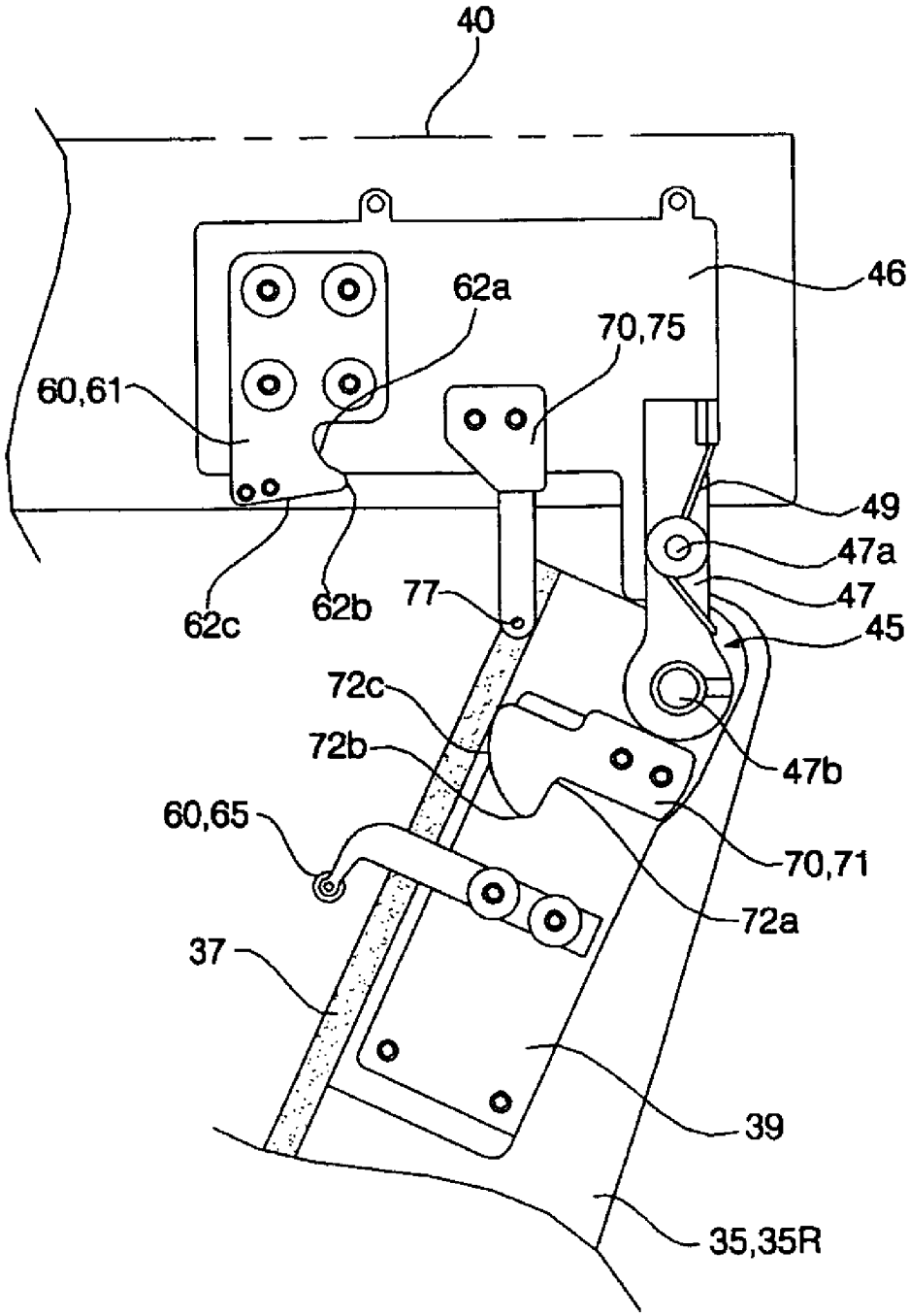
FIG. 7 is an enlarged view of the door opening and closing device in accordance with the first embodiment of the present invention.
Figure 8:
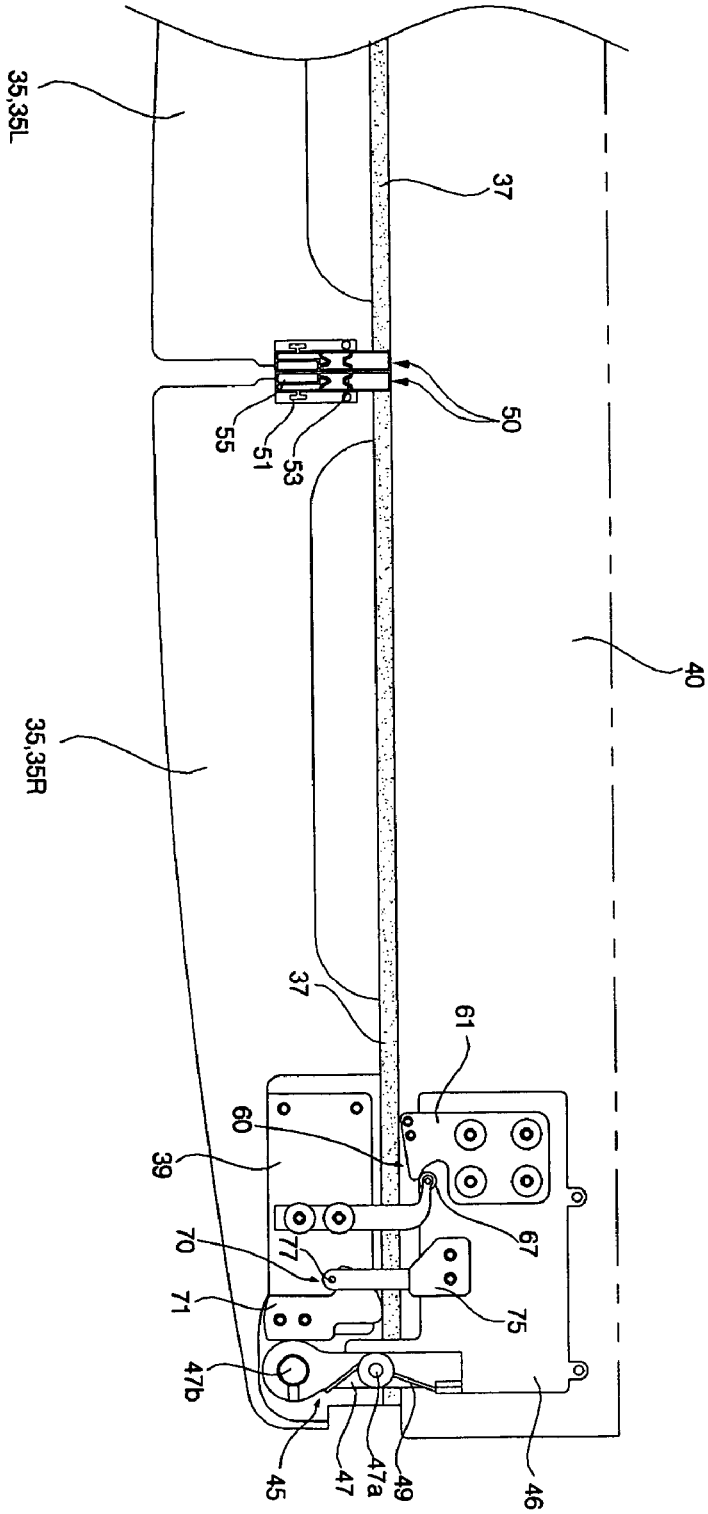
FIG. 8 is a schematic plan view of the refrigerator in accordance with the first embodiment of the present invention in a state in which doors are closed.

FIG. 5 is a perspective view of a refrigerator having a door opening and closing device in accordance with a first embodiment of the present invention. FIG. 6 is an enlarged view of the portion "A" of FIG. 5. FIG. 7 is an enlarged view of the door opening and closing device in accordance with the first embodiment of the present invention. FIG. 8 is a schematic plan view of the refrigerator in accordance with the first embodiment of the present invention in a state in which doors are closed.

As shown in FIG. 5, both doors 35L and 35R are connected to a refrigerator main body 40 by hinge units 45, thereby opening and closing a refrigerating chamber.

Gaskets 37, which contact the refrigerator main body 40 for preventing cold air in the refrigerating chamber from leaking to the outside, are respectively installed on upper, lower, and outer side surfaces of both doors 35L and 35R.

Side gasket assemblies (hereinafter, referred to as "gasket assemblies") 50, which contact each other for sealing a gap between the doors 35L and 35R, are respectively installed on inner side surfaces of both doors 35L and 35R.

As shown in FIG. 8, each of the gasket assemblies 50 comprises a gasket holder 51 installed in the inner side surface of the door 35L or 35R, a gasket 53 installed on the gasket holder 51 and contacting the opposing gasket 53, and a magnetic body 55 provided in the gasket 53 for generating magnetic force so that the gasket 53 is attracted to the opposing gasket 53.

In order to minimize the opening of the door 35L or 35R under the condition that both gasket assemblies 50 come into contact, there is provided a device for separating both gasket assemblies 50 from each other by translating, i.e., horizontally moving the doors 35L and 35R when the door 35L or 35R is opened or closed.

The above device for separating both gasket assemblies 50 from each other comprises a hinge unit 45, and two pairs of interference units 60 and 70.

The hinge unit 45 causes the door 35L or 35R to perform the rotational motion and the translational motion against the refrigerator main body 40. As shown in FIGS. 6 and 7, both ends of a hinge link 47 are rotatably connected to a hinge bracket 46 installed on the refrigerator main body 40 and the upper portion of the door 35L or 35R.

That is, one end of the hinge link 47 is connected to a bracket hinge shaft 47*a* of the hinge bracket 46, and the other end of the hinge link 47 is connected to a door hinge shaft 47*b* of the door 35L or 35R.

An elastic member 49 for providing elastic force in the direction in which both doors 35L and 35R come into contact is provided on the bracket hinge shaft 47*a* such that both ends of the elastic member 49 are supported by the hinge bracket 46 and the hinge link 47.

The hinge unit 45 is rotated centering on the door hinge shaft 47*b* when the door 35L or 35R is rotated to be opened or closed, and is rotated centering on the bracket hinge shaft 47*a* when the door 35L or 35R horizontally moves using the first interference units 60 and the second interference units 70. The elastic member 49 provides elastic force so that the hinge link 47 is rotated centering on the bracket hinge shaft 47*a* in the direction in which both doors 35L and 35R, i.e., both gasket assemblies 50, come into contact.

The first interference units 60 come into contact from a state in which the door 35L or 35R is closed to a state in which the door 35L or 35R is opened to a designated angle, thereby separating the doors 35L and 35R from each other. The second interference units 70 come into contact when the door 35L or 35R is opened above the designated angle and when the door 35L and 35R is closed, thereby separating the doors 35L and 35R from each other.

The first interference units 60 and the second interference units 70 are installed on the hinge bracket 46, on which the hinge unit 45 is installed, and the door bracket 39. The first interference units 60 are respectively located at positions of the hinge bracket 46 and the door bracket 39 close to the hinge unit 45, and the second interference units 70 are respectively located at positions of the hinge bracket 46 and the door bracket 39 adjacent to the corresponding first interference units 60.

First, the first interference units 60 will be described, as below. The first interference units comprise a first cam member 61 fixed to the refrigerant main body 40 and having a cam plane 62 for separating both doors 35L and 35R from each other when the door 35L or 35R is opened, and a first cam contact lever 65 fixed to the door 35L or 35R and contacting the cam plane 62 of the first cam member 61 for separating both doors 35L and 35R from each other.

The first cam member 61 is installed on the upper surface of the refrigerant main body 40. Preferably, the front portion of the first cam member 61 is not protruded forwardly from the refrigerant main body 40. On the other hand, preferably, the first cam contact lever 65 is protruded from the upper surface of the door 35 towards the refrigerant main body 40.

The first cam contact lever 65 comprises a lever portion 66 fixed to the door bracket 39, and a roller 67 installed on the end of the lever portion 66 such that the roller 67 contacts the cam member 61.

Next, the second interference units 70 will be described, as below. The second interference units 70 comprise a second cam member 71 fixed to the door 35L or 35R for separating both doors 35L and 35R from each other when the door 35L or 35R is closed, and a second cam contact lever 75 fixed to the refrigerant main body 40 and contacting the second cam member 71 for separating both doors 35L and 35R from each other.

Preferably, the second cam member 71 is installed on the door bracket 39 fixed to the upper surface of the door 35L or 35R, and the second cam contact lever 75 is fixed to the hinge bracket 46 installed on the upper surface of the refrigerant main body 40 and is protruded from the refrigerant main body 40 towards the door 35L or 35R.

The second cam contact lever 75 comprises a lever portion 76 installed on the hinge bracket 46, and a boss 77 protruded from the end of the lever portion 76 and contacting the second cam member 71.

When the door 35L or 35R is opened, the door 35L or 35R horizontally moves by means of the first interference units 60 in the direction in which the door 35L or 35R is separated from the opponent door 35R or 35L, and when the door 35L or 35R is closed, the door 35L or 35R horizontally moves by means of the second interference units 70 under the condition that the returning trajectory of the door 35L or 35R is changed so as to prevent the door 35L or 35R from colliding with the opponent door 35R or 35L. The above operation is performed by the trajectories of the cam planes 62 and 72 of the first and second cam members 61 and 71.

The cam planes 62 and 72 of the first and second cam members 61 and 71 are convexly curved, and are opposite to each other.

The cam plane 62 of the first cam member 61, as shown in FIG. 7, includes a contact cam plane 62*a* and a non-contact cam plane 62*c*, which are divided by a vertex 62*b*. The contact cam plane 62*a* is a relatively steeply curved plane so that the roller 67 of the first cam contact lever 65 contacts the contact cam plane 62*a* to rapidly separate both doors 35L and 35R and both gasket assemblies 50 from each other when the door 35L or 5R is opened, and the non-contact cam portion 62*c* is a gently curved plane so that the roller 67 of the first cam contact lever 65 does not contact the non-contact cam plane 62*c* by means of the second interference units 70.

The cam plane 72 of the second cam member 71 includes a non-contact cam plane 72*a* and a contact cam plane 72*c*, which are divided by a vertex 72*b*. The non-contact cam plane 72*a* is a steeply curved plane so that the boss 77 of the second cam contact lever 75 does not contact the non-contact cam plane 72*a* by means of the first interference units 60, and the contact cam plane 72*c* is a relatively gently curved plane, compared to the contact cam plane 62*a* of the first cam member 61 so that the door 35L or 35R gradually moves horizontally when the door 35L or 35R is opened or closed.

Accordingly, when the door 35L or 35R in a closed state is opened, the roller 67 of the first cam contact lever 65 moves along the contact cam plane 62*a* of the first cam member 61, thereby rapidly separating the doors 35L and 35R from each other. At this time, the boss 77 of the second cam contact lever 75 does not contact the non-contact cam plane 72*a* of the second cam member 71. On the other hand, when the door 35L or 35R in an opened state is closed, the boss 77 of the second cam contact lever 75 moves along the contact cam plan 72*c* of the second cam member 71, thereby gradually separating the doors 35L and 35R from each other. At this time, the roller 67 of the first cam contact lever 65 does not directly contact the non-contact cam plane 62*c* of the first cam member 61.

Hereinafter, the function of the above-described door opening and closing device for the refrigerator in accordance with the first embodiment of the present invention will be described with reference to FIGS. 8 to 12.

Figure 9:
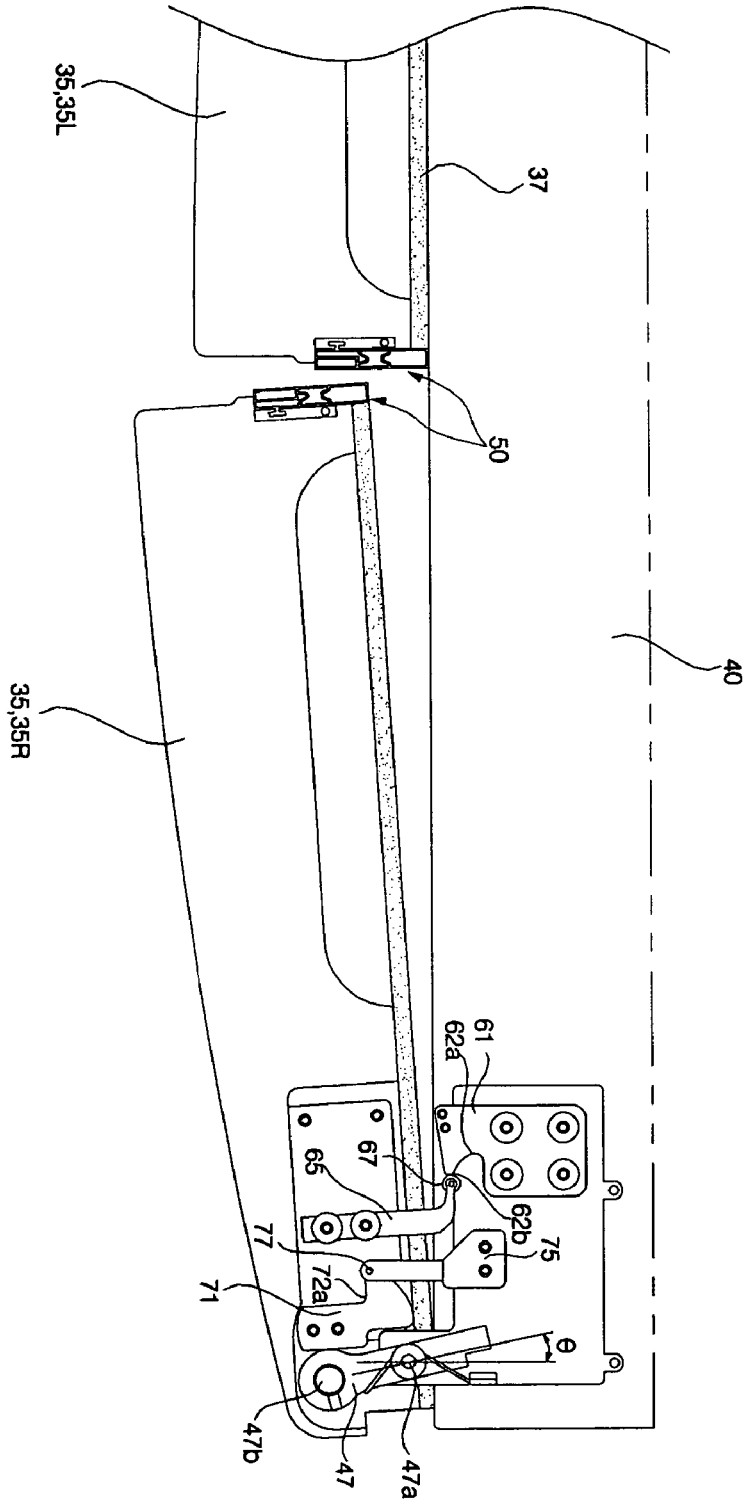
FIG. 9 is a schematic plan view of the refrigerator in accordance with the first embodiment of the present invention in a state in which gaskets are separated from each other when one door is opened or closed.
Figure 10:
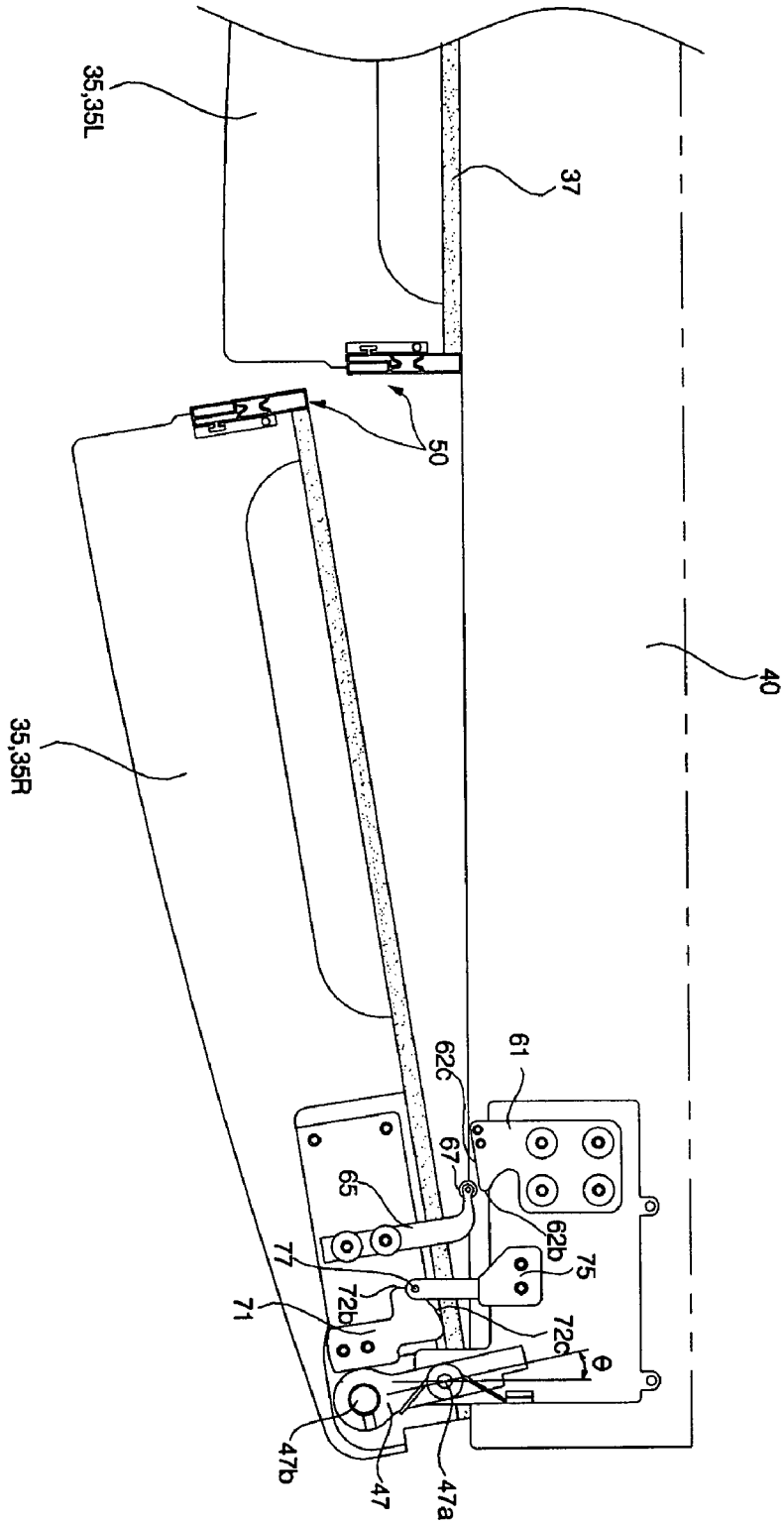
FIGS. 10 to 12 are schematic plan views of the refrigerator in accordance with the first embodiment of the present invention in a state in which the door is opened.
Figure 11:
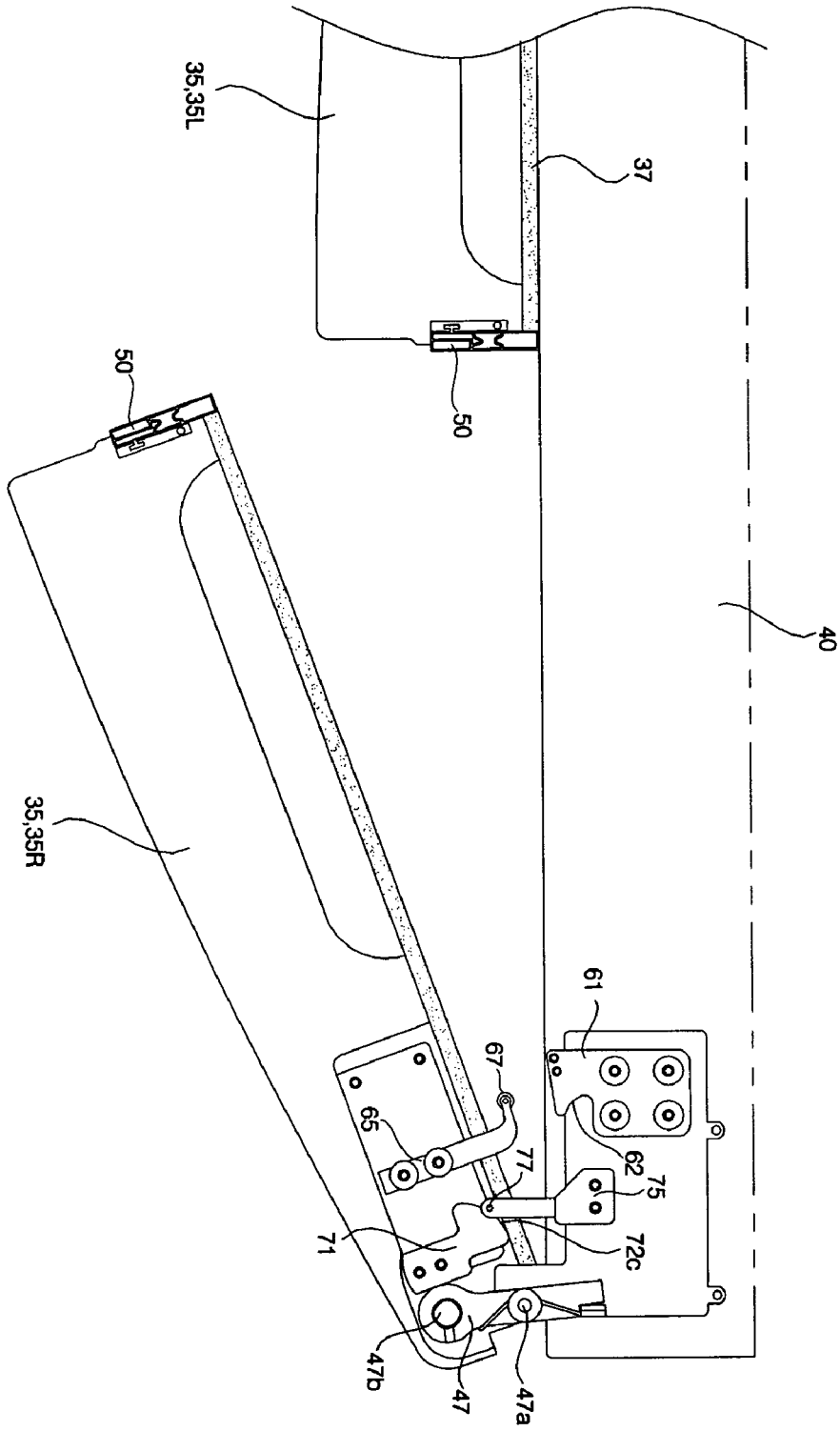
Figure 12:
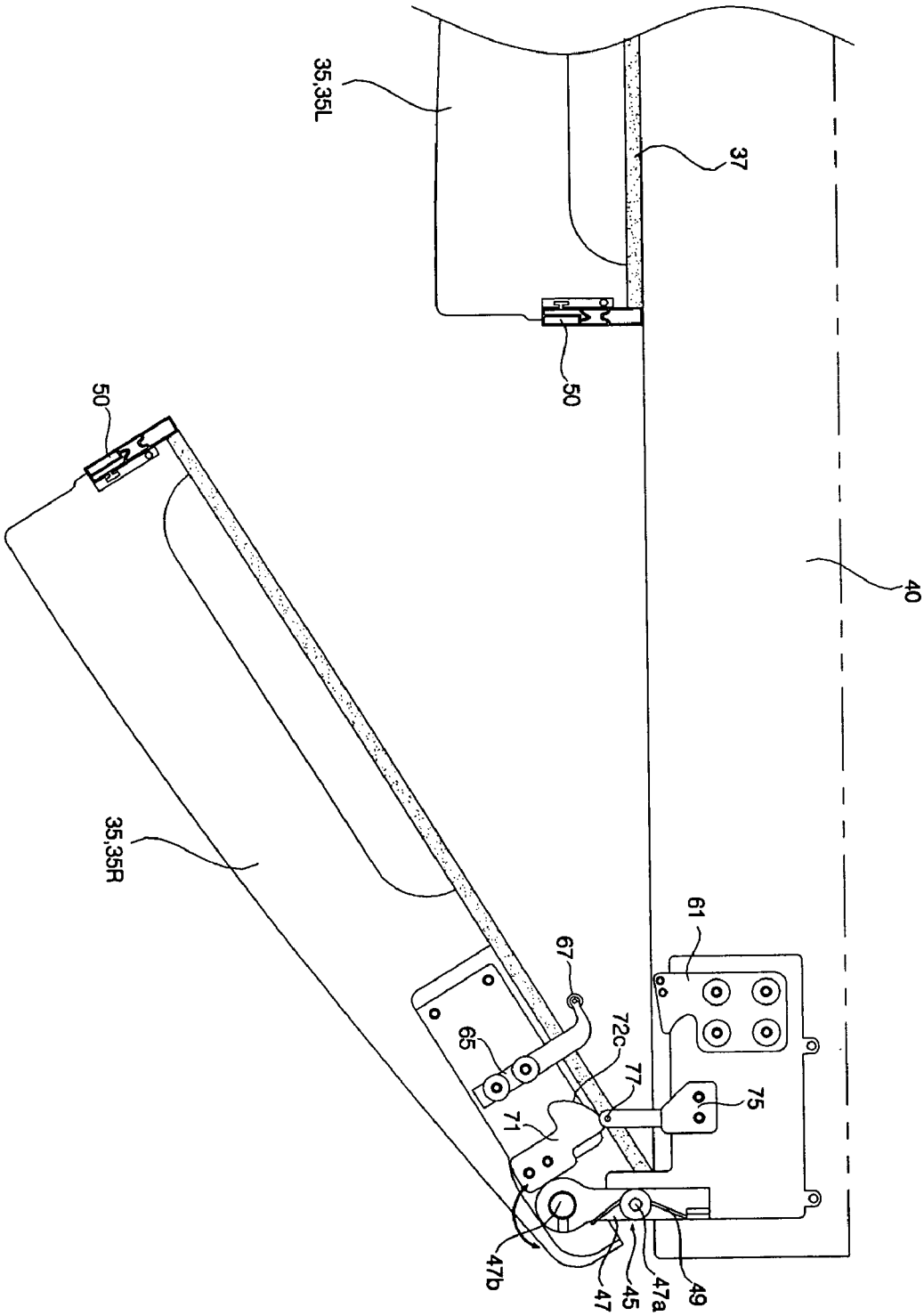

FIG. 8 is a schematic plan view of the refrigerator in a state in which doors are closed. FIG. 9 is a schematic plan view of the refrigerator in which gaskets are separated from each other when one door is opened or closed. FIGS. 10 to 12 are schematic plan views of the refrigerator in a state in which the door is opened.

First, a process for opening a door will be described, as below. Hereinafter, for convenience, the right door 35R is opened.

Under the condition that the doors 35L and 35R are closed, as shown in FIG. 8, the first interference units 60 are connected and the second interference units 70 are connected. That is, since the right door 35R moves close to the left door 35L by the elastic force of the elastic member 49 of the hinge unit 45, the gaskets 53 of both doors 35L and 35R contact each other.

Since the elastic member 49 provides the elastic force for rotating the hinge link 47 in the clockwise direction centering on the bracket hinge shaft 47*a*, the right door 35R moves towards the opponent left door 35L.

When the right door 35R is opened under the above state, as shown in FIG. 9, the roller 67 of the first cam contact lever 65 moves along the contact cam plane 62*a* of the first cam member 61 according to the opening of the right door 35R, and horizontally moves the right door 35R to be separated from the left door 35L. When the roller 67 reaches the vertex 62*b* of the cam plane 62 of the first cam member 61, the right door 35R reaches the maximum displacement. Since the right door 35R is pushed by force generated due to the contact between the roller 67 and the contact cam plane 62*a* and the vertex 62*b*, the hinge link 47 of the hinge unit 45 presses the elastic member 49 and is rotated at a designated angle (θ) in the counterclockwise direction centering on the bracket hinge shaft 47*a*.

Simultaneously, the boss 77 of the second cam contact lever 75 does not contact the non-contact cam plane 72*a* of the cam plane 72 of the second cam member 71, and reaches the vertex 72*b* of the cam plane 72.

Accordingly, since the right door 35R rapidly moves horizontally by means of the contact cam plane 62*a* of the first cam member 61 having a relatively steep gradient, the right door 35R is opened under the condition that the gasket assemblies 50 of both doors 35R and 35L are rapidly separated from each other.

Thereafter, when the right door 35R is further opened to a larger angle, as shown in FIGS. 10 and 11, the roller 67 of the first cam contact lever 65 passes by the vertex 62*b* of the cam plane 62 of the first cam member 61 and is gradually spaced from the cam plane 62, and the boss 77 of the second cam contact lever 75 passes by the vertex 72*b* of the cam plane 72 of the second cam member 71 and contacts the contact cam plane 72*c* of the cam plane 72.

In order to rapidly separate the gasket assemblies 50, which come into contact when the right door 35R is closed, simultaneously with the opening of the right door 35R, the door 35R is gradually returned to its original position and is opened by the contact between the second cam contact lever 75 and the contact cam plane 72*c* of the cam plane 72 of the second cam member 71.

At this time, the hinge link 47 is rotated in the clockwise direction by the elastic force of the elastic member 49.

Thereafter, when the door 35 is further opened to a larger angle so that the boss 77 of the second cam contact lever 75 is separated from the contact cam plane 72*c* of the cam plane 72 of the second cam member 71, as shown in FIG. 12, the hinge link 47 is rotated in the clockwise direction and is completely returned to its original position, and the right door 35R is rotated centering on the door hinge shaft 47*b* and is opened.

Next, a process for closing a door will be described, as below. Hereinafter, for convenience, the right door 35R is closed also.

When the right door 35R is closed, the boss 77 of the second cam contact lever 75 contacts the contact cam plane 72*c* of the cam plane 72 of the second cam member 71, as shown in FIG. 12, and then moves along the contact cam plane 72*c* having a gentle gradient, as shown in FIGS. 10 and 11.

At this time, the right door 35R gradually horizontally moves backwards by means of the contact between the boss 77 of the second cam contact lever 75 and the contact cam plane 72*c* of the cam plane 72 of the second cam member 71, and the hinge link 47 is gradually rotated in the counterclockwise direction centering on the bracket hinge shaft 47*a*.

When the right door 35R is closed so that the boss 77 of the second cam contact lever 75 reaches the vertex 72*b* of the cam plane 72 of the second cam member 71, as shown in FIG. 9, the right door 35R reaches the maximum displacement. At this time, the gasket assemblies 50 of both doors 35L and 35R are separated from each other.

Thereafter, when the right door 35R is further closed to a smaller angle, the boss 77 of the second cam contact lever 75 passes by the vertex 72*b* of the cam plane 72 of the second cam member 71 and does not contact the cam plane 72, and the roller 67 of the first cam contact lever 65 contacts the contact cam plane 62*a* of the cam plane 62 of the first cam member 61. Thereby, the right door 35R rapidly horizontally moves towards the left door 35L, and is closed. At this time, the gasket assemblies 50 of both doors 35L and 35R contact, as shown in FIG. 8, thereby sealing the inside of the refrigerator.

Accordingly, when the right door 35R is closed, the boss 77 of the second cam contact lever 75 contacts the contact cam plane 72*c* of the cam plane 72 of the second cam member 71, thereby gradually horizontally moving the right door 35R so that the right door 35R is separated from the left door 35L. Thus, when the right door 35R is closed, the gasket assemblies 50 of both doors 35L and 35R are normally separated from each other without collision between the first cam contact lever 65 and the non-contact cam plane 62*c* of the cam plane 62 of the first cam member 61.

Hereinafter, second and third embodiments of the present invention will be described. For reference, some parts in these embodiments, which are substantially the same as those in the first embodiment, are denoted by the same reference numerals even though they are depicted in different drawings, and a detailed description thereof will thus be omitted because it is considered to be unnecessary.

Figure 13:
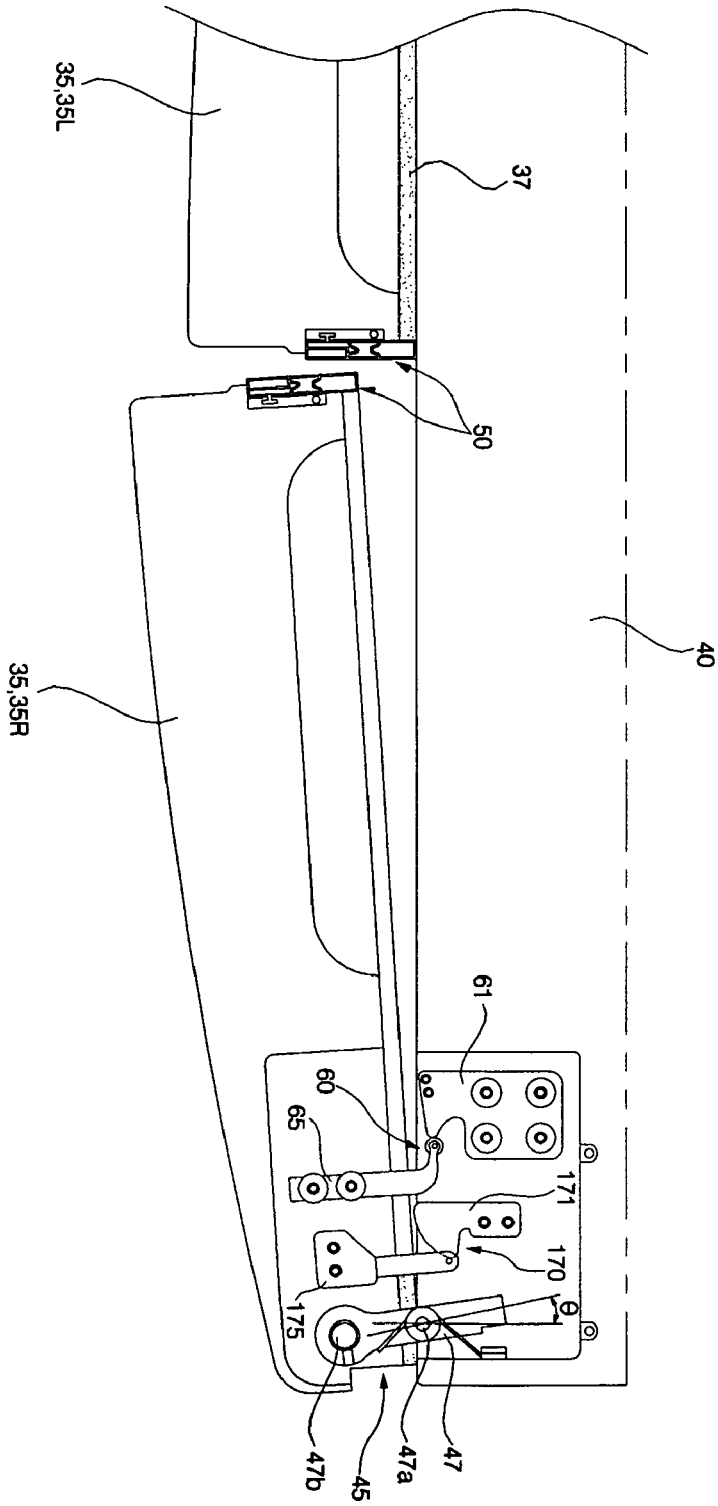
FIG. 13 is a schematic plan view of a refrigerator having a door opening and closing device in accordance with a second embodiment of the present invention in a state in which gaskets are separated from each other when one door is opened or closed.

FIG. 13 is a schematic plan view of a refrigerator having a door opening and closing device in accordance with a second embodiment of the present invention in a state in which gaskets are separated from each other when one door is opened or closed.

The door opening and closing device of the second embodiment has the same constitution as that of the first embodiment except for the installation positions of a second cam member 171 and a second cam contact lever 175 of second interference units 170.

That is, the second cam member 171 of the second interference units 170 is installed on the refrigerant main body 40, and the second cam contact lever 175 of the second interference units 170 is fixed to the door 35L or 35R. The second cam contact lever 175 contacts the second cam member 171, thereby separating the doors 35L and 35R from each other.

The function of the door opening and closing device of the second embodiment is the same as that of the door opening and closing device of the first embodiment, and a detailed description thereof will thus be omitted because it is considered to be unnecessary.

Figure 14:
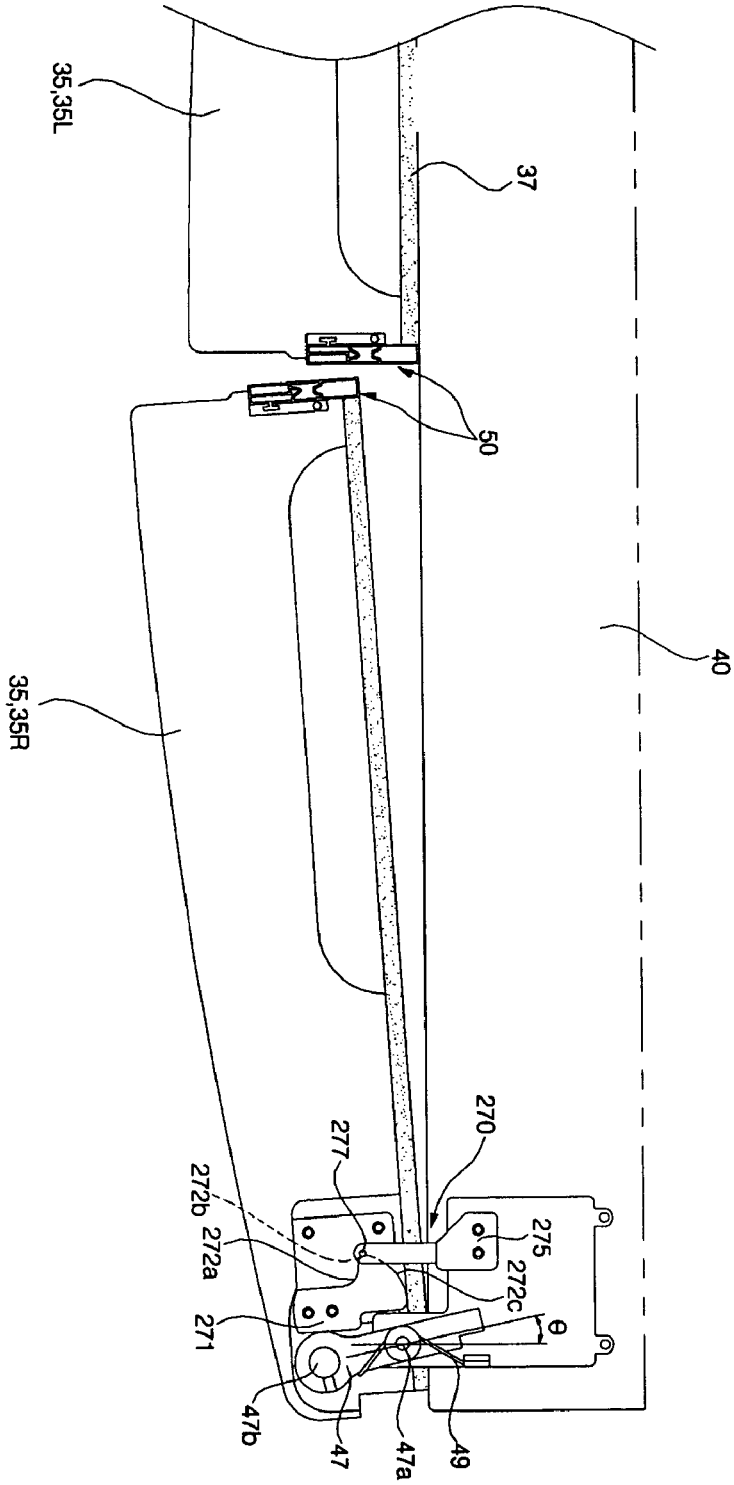
FIG. 14 is a schematic plan view of a refrigerator having a door opening and closing device in accordance with a third embodiment of the present invention in a state in which gaskets are separated from each other when one door is opened or closed.

FIG. 14 is a schematic plan view of a refrigerator having a door opening and closing device in accordance with a third embodiment of the present invention in a state in which gaskets are separated from each other when one door is opened or closed.

The door opening and closing device of the third embodiment does not comprise first interference units, and comprises only second interference units 270.

That is, the second interference units 270 comprise a cam member 271 installed on the upper surface of the door 35L or 35R, and a cam contact lever 275 protruded from the refrigerator main body 40 and contacting the cam member 271 for separating the doors 35L and 35R from each other when the door 35L is opened or closed.

The second interference units 270 of the door opening and closing device of the third embodiment have the same constitution as the second interference units 70 of the door opening and closing device of the first embodiment except for a cam plane 272 of the cam member 271 for separating the doors 35L and 35R when one door 35L or 35R is opened.

That is, the cam plane 272 of the second cam member 271 includes a first contact cam plane 272*a* and a second contact cam plane 272*c*, which are divided by a vertex 272*b*. The first contact cam plane 272*a* is a relatively steeply curved plane so as to rapidly separate the doors 35L and 35R from each other when one door 35L or 35R is opened, and the second contact cam plane 272*c* is a relatively gently curved plane so as to reduce impact caused by the contact between the gasket assemblies 50 when one door 35L or 35R is closed.

Accordingly, when the right door 35R is opened, a boss 277 of the cam contact lever 275 moves along the first contact cam plane 272*a* of the cam plane 272 of the cam member 271, thereby moving the right door 35R so that both gasket assemblies 50 are separated from each other. Then, when the boss 277 passes by the vertex 272*b* and contacts the second contact cam plane 272*c*, the right door 35R is gradually returned to its original position and is opened.

When the right door 35R is closed, the boss 277 of the cam contact lever 275 contacts the second contact cam plane 272*c* of the cam member 271 and gradually moves so that the right door 35R is softly closed without impact under the condition that the gasket assemblies 50 are separated from each other.

As described above, the door opening and closing device in accordance with the third embodiment of the present invention smoothly opens and closes the doors using a pair of interference units without impact caused by the contact between the doors.

As apparent from the above description, the present invention provides a door opening and closing device for a refrigerator, which separately comprises interference units for separating doors from each other when one door is opened and interference units for separating the doors from each other when one door is closed, thereby reducing impact and noise generated by the opening and closing of the doors and thus allowing a user to open and close the doors more softly and smoothly.

Further, the door opening and closing device of the present invention minimizes impact generated by the opening and closing of the doors, thereby improving durability of elements of the interference units for separating the doors from each other. The door opening and closing device of the present invention minimizes the protrusion of cam contact levers from a refrigerator main body, thereby improving the external appearance of the refrigerator when the door is opened.

Moreover, since a cam plane used when the door is initially opened and a cam plane used after the door is opened to a designated angle are separately formed, the door opening and closing device of the present invention reduces impact generated by the opening and closing of the door compared to the conventional door opening and closing device using a pair of interference units, thereby improving user's tactility.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A door opening and closing device for a refrigerator comprising:

a plurality of doors to open and close a refrigerator main body;

a hinge unit configured to connect each door to the refrigerator main body so that the door can perform rotational motion or translational motion against the refrigerator main body;

first interference units provided between each door and the refrigerator main body, and contacting therebetween from a state in which the door is closed to a state in which the door is opened to a designated angle, the first interference units causing the door to move outwardly in a width direction of the door during opening, the first interference units comprising a first horizontally extending cam member fixed to one of the refrigerator main body and a door, and a first horizontally extending cam contact lever fixed to the other of the refrigerator body and door and contacting the first cam member to separate the doors; and second interference units provided between each door and the refrigerator main body, and contacting therebetween during a state in which the door is opened to an angle greater than the designated angle, the second interference units causing the door to move outwardly in a width direction of the door during closing, wherein the second interference units comprise a second horizontally extending cam member fixed to one of the refrigerator main body and the door, and a second horizontally extending cam contact lever fixed to the other of the refrigerator main body and door and contacting the second horizontally extending cam member to separate the doors, wherein the second cam member is located on the upper surface of the door, and the second cam contact lever protrudes horizontally from the upper surface of the refrigerator main body toward the door, and wherein a portion of a cam plane of the second cam member, contacting the second cam contact lever when the door is opened above the designated angle, is curved at a gradient less than that of the other portion of the cam plane of the second cam member, said portions of the cam plane being divided by a vertex.

2. The door opening and closing device as set forth in claim 1, wherein gasket assemblies that seal a gap between the doors are installed between the doors.

3. The door opening and closing device as set forth in claim 1, wherein the hinge unit comprises a hinge link, both ends of which are rotatably connected to the refrigerator main body and the door.

4. The door opening and closing device as set forth in claim 3, wherein the hinge unit further comprises an elastic member that provides elastic force so that the door moves in the direction in which the door contacts the opponent door.

5. The door opening and closing device as set forth in claim 1, wherein the first cam member is fixed to the refrigerator main body, and the first cam contact lever is fixed to the door.

6. The door opening and closing device as set forth in claim 5, wherein the first cam member is located on the upper surface of the refrigerator main body, and the first cam contact lever is protruded horizontally from the upper surface of the door towards the refrigerator main body.

7. The door opening and closing device as set forth in claim 1, wherein the second interference units are disposed between the first interference units and the hinge unit.

8. The door opening and closing device as set forth in claim 1, wherein a cam plane of the first cam member and a cam plane of the second cam member are convexly curved planes.

9. The door opening and closing device as set forth in claim 8, wherein the cam plane of the first cam member and the cam plane of the second cam member protrudes in the directions in which the cam planes face each other.

10. The door opening and closing device as set forth in claim 8, wherein: a portion of the cam plane of the first cam member, contacting the first cam contact lever when the door is opened, is curved; and a portion of the cam plane of the second cam member, contacting the second cam contact lever when the door is closed, is curved to a lesser degree than the portion of the cam plane of the first cam member.

11. The door opening and closing device as set forth in claim 8, wherein at least one of the first cam contact lever and the second cam contact lever comprises a roller rolling on the first or second cam member.

* * * * *